US006495079B1

(12) United States Patent
Gallucci et al.

(10) Patent No.: US 6,495,079 B1
(45) Date of Patent: Dec. 17, 2002

(54) PROCESS TO PREPARE POLYMERIC FIBERS WITH IMPROVED COLOR AND APPEARANCE

(75) Inventors: Robert R. Gallucci, Mt. Vernon, IN (US); Matthew B. Studholme, Abingdon, VA (US); Milton Keith Roark, Bristol, VA (US)

(73) Assignees: Prisma Fibers, Inc., Bristol, VA (US); General Electric Company, New York, NY (US)

( * ) Notice: Subject to any disclaimer, the term of this patent is extended or adjusted under 35 U.S.C. 154(b) by 216 days.

(21) Appl. No.: 09/604,990

(22) Filed: Jun. 28, 2000

(51) Int. Cl.[7] ..... D01D 5/098; D01F 1/04; D01F 6/60; D01F 6/62

(52) U.S. Cl. ..... 264/78; 264/210.6; 264/210.8; 264/211

(58) Field of Search ..... 264/78, 210.6, 264/210.8, 211

(56) References Cited

U.S. PATENT DOCUMENTS

| | | | | |
|---|---|---|---|---|
| 2,465,319 | A | | 3/1949 | Whinfield |
| 3,047,539 | A | | 7/1962 | Pengilly |
| 3,542,743 | A | | 11/1970 | Flamand |
| 3,846,507 | A | | 11/1974 | Thomm et al. |
| 3,898,200 | A | | 8/1975 | Lofquist |
| 4,374,641 | A | | 2/1983 | Burlone |
| 4,391,968 | A | | 7/1983 | Merani et al. |
| 4,479,718 | A | | 10/1984 | Alman |
| 4,579,762 | A | | 4/1986 | Ucci |
| 4,680,212 | A | | 7/1987 | Blyth et al. |
| 4,780,099 | A | | 10/1988 | Greschler et al. |
| 5,108,684 | A | | 4/1992 | Anton et al. |
| 5,164,261 | A | | 11/1992 | Windley |
| 5,674,948 | A | | 10/1997 | Vonk |
| 6,133,382 | A | * | 10/2000 | Studholme ..... 525/425 |

FOREIGN PATENT DOCUMENTS

| | | |
|---|---|---|
| WO | WO 96/17982 A1 | 6/1996 |
| WO | WO 97/07962 A1 | 3/1997 |
| WO | WO 00/04095 A1 | 1/2000 |

* cited by examiner

*Primary Examiner*—Leo B. Tentoni
(74) *Attorney, Agent, or Firm*—Miles & Stockbridge P.C.; John C. Kerins

(57) ABSTRACT

The use of a sulfonated polyester ionomer resin in a colored, drawn polyamide or polyester fiber results in improved color strength and appearance. Sodium sulfo isophthalate polybutylene terephthalate copolymers when melt blended with synthetic polyamides or polyesters are shown to enhance color strength in drawn fibers. In addition the sulfonated polyesters reduce color strength variation in colored fibers made with different batches of colorant. Water insoluble sulfonated polyester ionomers are preferred.

18 Claims, No Drawings

PROCESS TO PREPARE POLYMERIC FIBERS WITH IMPROVED COLOR AND APPEARANCE

FIELD OF THE INVENTION

The invention relates generally to a process to prepare drawn melt-spun polymeric fibers colored during the melt-spinning process. More particularly, the invention relates to a process to form polyamide or polyester based melt-colored fibers, containing novel polyester ionomer additive(s), that exhibit improved color and aesthetics over prior art melt-colored fibers.

BACKGROUND

Coloration of fibers has a long history, and the science of dyeing, initially of natural fibers such as flax, cotton and wool, has been under continuous development since Neolithic times. The appearance of man-made fibers, (e.g. cellulosics, acrylics, polyamides and polyesters), stimulated further developments in dyeing, and this method of coloring of fibers and articles made therefrom continues to be the most-practised technique for the production of colored fiber-based articles of manufacture.

In the case of fibers based on the more recent polymers such as polyamides and polyesters, which are spun from the melt, there exists an alternative method for coloration, i.e. addition of the colorant species into said melt and direct extrusion of colored fibers. While such a process may be carried out with dyes, it is more often carried out with pigments, (although the said process is popularly known in the industry as "solution dyeing"). The major difference between dyes and pigments is that, under prevailing processing conditions, pigments are virtually insoluble in polymers, whereas dyes are soluble, (see definitions in German Standards DIN 55943, 55944 and 55949).

As the technique of melt-pigmentation has been developed, it has been demonstrated that fibers made in this way can exhibit certain advantages over those made by post-spinning dyeing of fibers. Such advantages include—improvements to resistance to degradation and fading in sunlight; lower susceptibility to fading and/or yellowing by polluting gases in the atmosphere, such as ozone and nitrogen oxides; improved resistance to chemicals, either in dry-cleaning processes or due to accidental spillage; less leaching or fading of color during laundering or cleaning process involving water and detergents; no need for post-spinning dyeing, or the other processes involved in applying and fixing said dyes onto/into the fiber.

However, melt-pigmentation is also considered to have some disadvantages in terms of the color and appearance obtained in the final fiber. The fibers are known to those skilled in the art to exhibit degrees of lustre and low brightness which can render the said fibers unsuitable in certain applications.

The color change resulting from the addition of pigments to polymers is based on the wavelength-dependant absorption and scattering of light, the appearance and color of the final product being a combination of these two factors as described in the Kubelka-Munk theory. [Note that a description of this theory, and the general concepts of color and its measurement may be found in "Colour Physics for Industry", Roderick McDonald (Ed.), The Society of Dyers and Colourists, Bradford, UK, 2$^{nd}$ edition (1997)]. Dyes can only absorb light and not scatter it, since the physical prerequisite for scattering—a certain minimum particle size—does not exist in the case of dyes in molecular solution; these colors are therefor transparent. In so far as the transparency is attributable to the dye, complete absorption of the light will result in black shades, selected absorption in colored shades.

The optical effect of pigments may in the same way be based on light absorption. If, however, the refractive index of the pigment differs appreciably from that of the polymer (which is almost always the case) and, if a specific particle size range is present, scattering takes place; the initially transparent polymer becomes white and opaque, or if selective absorption takes place at the same time, colored and opaque.

No scattering occurs when the particle sizes are very small, and none or very little if they are very large. With all colored pigments that selectively absorb, the shade and strength of the final color is thus influenced by particle size. The transparency and thickness of the colored substrate may additionally affect the color strength. While some pigments are available in so-called transparent grades (e.g. red and yellow iron oxides) a complete color range across the spectrum is not readily available. Many such ultra-low particle size colorants are expensive, and difficult to maintain at high dispersion when compounded into a polymer matrix. It is also known that very low particle size additives in polymer melts can exhibit a profound effect on the Theological properties of said melt, resulting in formulations which are difficult to spin using standard equipment and techniques. Use of large particle size pigments is not a viable option either, as such additives will result in blocking of filtration systems and spinneret holes, and tend to lead to filament breaks in fiber production.

In any case, a large number of melt-pigmented fiber products are required to be opaque, and the problem lies in producing opaque colored fibers with levels of color brightness close to those of dyed products. Note that a fundamental difference between dyeing and pigmenting of fibers is that, while dyes are either colored or absorb all wavelengths (i.e. give black shades), pigmentation introduces an extra variable in that white pigments are readily available, whereas there is no such species as a "white dye".

Another potential problem with particulate colorants in a polymeric melt-extruded product is the phenomenon of dichroism, or optical anisotropy. Pigment particles are not necessarily isotropic in shape, and may be needle-shaped, rod-shaped, or platelets. They may thus become oriented in a particular direction in processing. The apparent color then depends on the direction of observation. The origin of this phenomenon is to be found in the fact that certain pigments crystallise in crystal systems of low symmetry resulting in directionally dependant physical properties. As far as the coloristic properties are concerned, this signifies that the absorption and scattering constants differ in the various principle crystallographic axes, i.e. such crystals are optically anisotropic.

With regard to the final fiber (as opposed to the above comments on the pigments themselves) the appearance of a sample thereof can vary depending on the angle of illumination and/or observation. Fiber samples are normally prepared for color and appearance testing by carefully wrapping the fiber or yarn sample (under conditions of uniform tension and consistent positioning of the said fibers) around a flat "card", and assessing the color properties, and more importantly any differences between said properties and those of the desired standard sample or data, under standard conditions of illumination and observation. This may be carried out visually, but more usually instrumentally. Methods and apparatus for carrying out the analysis of color and appearance in this manner are well known to those skilled in the art.

During such examinations, there are two additional effects which might be observed if the sample is illuminated or observed at a number of different angles (for an example of multi-angle appearance testing of materials see U.S. Pat. No. 4,479,718, assigned to DuPont). The total amount of light reflected from the sample, per unit area, may change. The perceived color may also change. Unless such effects are specifically desired for particular aesthetic effects in a final article of manufacture, the appearance of either may result in the rejection of the fiber by the prospective customer. Eradication or reduction of such effects thus is important in obtaining first quality product.

There thus exists a need in the industry for a simple method to provide pigmented polymeric articles, especially melt-spun fibers, with improved color and appearance, whilst still using standard grades of pigment currently known to those skilled in the art to be suitable for this purpose, and equipment and techniques known to produce melt-pigmented fibers of the required properties for use in manufactured articles such as fabrics, textiles, carpets, threads, etc.

Vonk (U.S. Pat. No. 5,674,948) has claimed that end-capping of the amino end-groups of polyamides results in improvements to the brightness of compositions colored with organic pigments which are capable of themselves reacting with such amino end-groups. N-acetyl lactam is noted as a particularly preferred end-capper. This approach does not, however, fully solve the problem. The effect is limited to a particular set of organic pigments, and appears to be limited to use for colored polyamides only. The levels of additive end-capper are also quite high, in order to produce a sufficient reduction in amine end-group level to produce a noticeable effect. Finally, the use of this method requires a prior knowledge of the amine end-group level in the polyamide, (a non-trivial analytical task), and requires that the additive end-capper level be varied from polyamide to polyamide, (and potentially from batch to batch of the same polyamide), to account for the differing levels of amine end-groups therein.

The present inventors have discovered the surprising fact that addition of sulfonated polyester ionomer copolymers, at low levels, and irrespective of the type of colorant employed, results in the production of polyamide or polyester melt-pigmented fibers which exhibit improved color and appearance and reduced variation in color and appearance. The improvement in appearance between two samples can be measured as color strength. In order to fully achieve improved color and appearance, i.e. color strength, the fibers should be drawn.

EMBODIMENT

The polymer used as the base, or matrix, polymer in the practise of this invention is selected from the set consisting of fiber-forming polyamides or polyesters.

Polyamides include those synthesised from lactams, alpha-omega amino acids, and pairs of diacids and diamines. Such polyamides include, but are not limited to, polycaprolactam [polyamide 6], polyundecanolactam [polyamide 11], polylauryllactam [polyamide 12], poly(hexamethylene adipamide) [polyamide 6,6], poly(hexamethylene sebacamide) [polyamide 6,10], poly(hexamethylene dodecanediamide) [polyamide 6,12], and copolymers and blends thereof. Preferred polyamides are polyamide 6 and polyamide 6,6.

Polyesters include those synthesised from one or more diacids and one or more glycols. Such polyesters include, but are not limited to, poly(ethylene terephthalate) [PET], poly(propylene terephthalate) [PPT], poly(butylene terephthalate) [PBT], poly(ethylene naphthalate) [PEN], polybutylene naphthanoate [PBN], polypropylene naphthanoate [PPN], polycyclohexane dimethanol terephthalate [PCT] and copolymers and blends thereof. Preferred polyesters are PET, PBT and PPT.

Colorants used in the practise of this invention may be selected from the categories of dyes, inorganic or organic pigments, or mixtures of these. Any number of different colorants may be used, in any proportions, although it will be understood by those skilled in the art that the total loading of colorants in the polymer matrix, and the number of different colorants used, will be kept to a minimum commensurate with obtaining the color required. Generally the level of colorants will range from 0.1 to 8.0% of the fiber weight.

Inorganic pigment types include, but are not limited to, elements, oxides, mixed oxides, sulfides, aluminates, sodium sulfo-silicates, sulfates and chromates. Non-limiting examples of these include: carbon blacks, zinc oxide, titanium dioxides, zinc sulfides, zinc ferrites, iron oxides, ultramarine blue, Pigment Brown 24, Pigment Red 101, and Pigment Yellow 119.

Organic pigment types include, but are not limited to, azos, disazos, quinacridones, perylenes, naphthalene tetracarboxylic acids, flavanthrones, isoindolinones, tetrachloroisoindolinones, anthraquinones, anthanthrones, dioxazines, phthalocyanines, and azo lakes. Non-limiting examples of these include Pigment Blue 60, Pigment Red 122, Pigment Red 149, Pigment Red 177, Pigment Red 179, Pigment Red 202, Pigment Violet 29, Pigment Blue 15, Pigment Green 7, and Pigment Yellow 150.

Colorants may be added to the matrix polymer in a variety of ways. These include direct addition of colorant(s) to the matrix polymer, addition of single-pigment dispersions (i.e. addition of each colorant as a separate concentrate in a carrier resin), and addition of multiple colorant dispersions (i.e. addition of a single concentrate of mixed colorants, providing the desired color on let down into the matrix polymer, in a carrier resin). Any of these addition methods may be carried out as a separate compounding step prior to melt-spinning, or may be carried out on the melt-spinning apparatus itself. In either case, the colorant(s) may be added at any stage of the process, for example at the extruder throat, at any addition port on the extruder barrel, at the melt pump, or at the spinneret chamber. More than one addition point may be utilised in the case of single-pigment dispersions.

The carrier resin used to produce pigment concentrates may be selected from a set consisting of low or high molecular weight polymers which have suitable compatibility with the matrix resin. One ordinarily skilled in the art of polymer compounding and blending will be familiar with which carrier polymers should be used to obtain suitable results in each matrix resin. Preferred carrier resins are PET, PBT, PPT, sulfonated polyester ionomer copolymers, polyamide 6, polyamide 11, polyamide 12, polyamide 6,6, polyamide 6,10, polyamide 6,12, and copolymers and blends thereof.

Polyester ionomers, in the context of the present invention, are defined as polyester polymers derived from the reaction residue of an aryl carboxylic acid sulfonate salt, an aromatic dicarboxylic acid, an aliphatic diol or any of their ester-forming derivatives. The said polyester ionomers comprise some monovalent and/or divalent sulfonate salt units represented by the formula 1A:

$$(M^{n+}O_3S)_d\text{-}A\text{-}(C{=}O)_p\text{–}$$

or formula 1B:

$$(M^{n+}O_3S)_d\text{-}A\text{-}(OR''OH)_p$$

wherein p=1–3, d=1–3, and p+d=2–6, and A is an aryl group containing one or more aromatic rings: for example, benzene, naphthalene, anthracene, biphenyl, terphenyl, oxy diphenyl, sulfonyl, diphenyl or alkyl diphenyl, where the sulfonate substituent is directly attached to an aryl ring. These groups are incorporated into the polyester through carboxylic ester linkages. The aryl groups may contain one or more sulfonate substituents (d=1–3) and may have one or more carboxylic acid linkages (p=1–3). Groups with one sulfonate substituent (d=1) and two carboxylic linkages (p=2) are preferred. M is a metal, with valency n=1–5. Preferred metals are alkali metals or alkaline earth metals, where n=1 or 2. Zinc and tin are also preferred metals. R" is an alkyl spacer group: for example, —$CH_2CH_2$—, —$CH_2CH_2OCH_2CH_2$—, —$CH(CH_3)CH_2$—, —$CH_2CH_2CH_2$—, —$CH_2CH_2CH_2CH_2$—.

Typical sulfonate substituents that may be incorporated into the metal sulfonate polyester copolymer may be derived from the following carboxylic acids or their ester-forming derivatives: sodium sulfoisophthalic acid, potassium sulfoterephthalic acid, sodium sulfonaphthalenedicarboxylic acid, calcium sulfoisophthalate, potassium 4,4'-di(carbomethoxy)biphenyl sulfonate, lithium 3,5-di(carbomethoxy)benzene sulfonate, sodium p-carboxymethoxybenzene sulfonate, dipotassium 5-carbomethoxy-1,3-disulfonate, sodio sulfonaphthalene-2,7-dicarboxylic acid, 4-lithio sulfophenyl-3,5-dicarboxybenzene sulfonate, 6-sodio sulfo-2-naphthyl-3,5-dicarbomethoxybenzene sulfonate and dimethyl-5-[4-(sodiosulfo)phenoxy] isophthalate. Other suitable sulfonate carboxylic acids and their ester-forming derivatives are described in U.S. Pat. Nos. 3,018,272 and 3,546,008 herein incorporated by reference. The most preferred sulfonate polyesters are derived from lithium or sodium 3,5-dicarbomethoxybenzene sulfonate.

Preferred ionomer polyester polymer comprises divalent ionomer units represented by the formula 2:

$$\text{—}(C{=}O)\text{-}Ph(R)(SO_3\text{–}M^+)\text{-}(C{=}O)\text{—}$$

wherein R is hydrogen, halogen, alkyl or aryl, and M is a metal.

The most preferred polyester ionomer has the formula 3:

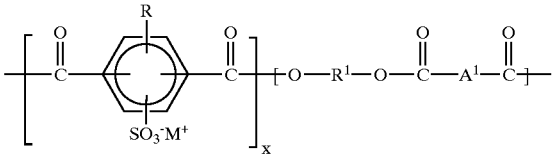

where the ionomer units, x, are from 0.1–50 mole percent of the polymer with 5 to 13 mole percent being preferred and 8 to 12 mole percent being especially preferred. Most preferably R is hydrogen. It is also preferred that the polyester sulfonate resin be water insoluble. In general water insoluble resins will be of high molecular weight (IV greater than or equal to 0.2dl/g in 60/40 phenol/tetrachloroethane solution) and have less than 15 mole percent sulfonate units in the polyester chain. Sulfonate copolymer polyester resins with IV≧0.3dl/g and with 8–12 mole percent sulfonate units are preferred.

Typical glycol or diol reactants, $R^1$, include straight chain, branched or cycloaliphatic alkane diols and may contain from 2 to 12 carbon atoms. Examples of such diols include, but are not limited to, ethylene glycol; propylene glycol, i.e. 1,2- and 1,3-propanediol; butane diol, i.e. 1,3- and 1,4-butanediol; diethylene glycol; 2,2-dimethyl-1,3-propanediol; 2-ethyl-2-methyl-1,3-propanediol; 1,3-pentanediol; 1,5-pentanediol, dipropylene glycol; 2-methyl-1,5-pentanediol; 1,6-hexanediol, dimethanol decalin; dimethanol bicyclooctane; 1,4-cyclohexane dimethanol and particularly its cis- and trans-isomers; triethylene glycol, 1,10-decanediol; and mixtures of any of the foregoing. A preferred cycloaliphatic diol is 1,4-cyclohexane dimethanol or its chemical equivalent. When cycloaliphatic diols are used as the diol component, a mixture of cis- and trans-isomers may be used, it is preferred to have a trans-isomer content of 70% or more. Chemical equivalents to the diols include esters, such as dialkyl esters, diaryl esters and the like.

Examples of aromatic dicarboxylic acid reactants, as represented by the decarboxylated residue $A^1$, are isophthalic acid or terephthalic acid, 1,2-di(p-carboxyphenyl) ethane, 4,4'-dicarboxydiphenyl ether-4,4'-bisbenzoic acid and mixtures thereof. All of these acids contain at least one aromatic nucleus. Acids containing fused rings can also be present, such as in 1,4-, 1,5- or 2,6-naphthalenedicarboxylic acids. The preferred dicarboxylic acids are terephthalic acid, isophthalic acid or mixtures thereof.

The most preferred ionomer copolyesters are poly(ethylene terephthalate) [PET], poly(propylene terephthalate) [PPT] or poly(1,4-butylene terephthalate) [PBT] ionomers. It is most preferred that the polyester metal sulfonate salt copolymers be insoluble in water.

Also contemplated herein are the above ionomers with minor amounts, e.g. from about 0.5 to about 15 percent by weight, of units derived from aliphatic acids and/or aliphatic polyols to form copolyesters. The aliphatic polyols include glycols, such as poly(ethylene glycol) or poly(butylene glycol). Such copolyesters can be made following the teachings of, for example, U.S. Pat. Nos. 2,465,319 and 3,047,539.

The polyester ionomers described above may be incorporated into the matrix polymer either during a melt-compounding step prior to fiber spinning, or during the fiber spinning process itself. These may be added in a separate process to the addition of the pigments, or may be added along with the said pigments. If the latter, it may be that the polyester ionomers are used as carrier resins for the said colorants, although this is not necessary for the practise of the present invention.

The amount of polyester ionomer(s) used in the practise of the present invention will vary depending on the types and amounts of colorants used to obtain any particular color. It has been found, in the course of extensive experimentation, that addition of said polyester ionomers to the melt formulation for spinning into fiber which produces a final sulfur level of between about 200 and about 5000 ppm gives the best results. The sulfonate polyester copolymers are to be used at 0.5 to 30% by weight of the fiber.

Besides the matrix polymers, colorants and polyester ionomers described above, the formulations used in the practise of the present invention may contain other components. These may include, but are not limited to—antioxidants, UV stabilisers, antiozonants, soilproofing agents, stainproofing agents, antistatic additives, antimicrobial agents, lubricants, melt viscosity enhancers, flame retardants and processing aids.

A formulation used in the practise of the present invention comprising:

1) A matrix polymer, selected from the set of fiber-forming polyamides and fiber-forming polyesters, as this is defined above;
2) A colorant system comprising of one or more colorants selected from the sets of inorganic and/or organic colorants as these are defined above, said colorant system optionally including one or more carrier resins for said pigments;
3) One or more sulfonated polyester copolymers, as these are defined above.

As stated previously, any or all of the above noted ingredients may be combined in a number of ways, either in a separate compounding step prior to actual melt-spinning of the fibers, or during the fiber spinning process itself. Both the separate compounding process and the fiber spinning process may be carried out using techniques and equipment well known to those ordinarily skilled in the arts of polymer compounding and fiber melt-spinning.

In order to achieve the full improvement in color strength and appearance it is necessary to draw the fibers formed from the sulfonated polyester blends. The optimum draw ratio will vary with the exact nature of the fiber matrix, colorant type and loading, sulfonate polyester type and concentration, fiber diameter and cross section shape. The draw ratio is defined as the ratio of the final length to the original length per unit weight of the yarn resulting from the drawing process. The optimum draw ratio for a given system can readily be determined by comparing the color strength of as spun fiber with that of the same fiber drawn under different conditions. In general a draw ratio from 1.05 to 7.00 may be used, with a draw ratio of 1.10 to 6.00 being more preferred. Fiber drawing may be achieved by any standard methods known in the art. The fiber may be drawn between two godet rolls, or pairs of rolls, or over a draw pin or pins, or a mixture of the two. The drawing may be done in single or multiple stages. The fiber is usually heated to a temperature above the glass transition temperature prior to, or during, drawing to minimise fiber breakage, although heating is not a requirement for the invention. The heating may be carried out via heating of godet rolls, plates, slits, pins or other means such as use of a heated chamber; hot gas such as steam, or hot liquid, such as water, may also be used.

The fibers produced from the practise of the present invention may be of a range of deniers per filament (dpf) depending on the ultimate use to which such fibers may be put—low dpf for textile use, higher dpf for use in carpets. The cross-sectional shape of the fibers may also be any of a wide range of possible shapes, including round, delta, trilobal, tetralobal, grooved, or irregular. These product fibers may be subjected to any of the known downstream processes normally carried out on melt-spun fibers, including crimping, bulking, twisting etc., to produce yarns suitable for incorporation into a variety of articles of manufacture, such as apparel, threads, textiles, upholstery and carpets.

EXAMPLES OF THE INVENTION

These examples are provided to illustrate the invention but are not intended to limit the scope of the invention in any way.

Color Strength Measurements: The color strength is defined as the color yield or color intensity of a given quantity of a colorant in a sample in relation to a standard, (or another sample). A higher color strength means a sample has a more intense color compared to the standard. The higher the color strength the greater the difference in color intensity compared to the standard. When samples with the same type and amount of pigment are compared, (as is the case in all examples of this invention), a higher color strength means that the more intense colored sample formulation can reach the same intensity as the standard with less pigment. This allows for more efficient use of the colorant.

Color strength was determined from the spectrophotometric data using the (K/S)□ summation method, where (K/S)□ is the Kubelka-Munk function (also referred to herein simply as K/S), where K is the absorption coefficient and S is the scattering coefficient. The % color strength of a sample is defined as the ratio of the sum of (K/S)□ for the sample to the sum of (K/S)□ for the standard expressed as a percentage. A percentage less than 100% indicates that the sample is less intense in color strength than the standard; a percentage greater than 100% indicates that the sample is more intense than the standard. Further details of the (K/S)□ summation method can be found in "Colour Physics for Industry", Roderick McDonald (Ed.), The Society of Dyers and Colourists, Bradford, UK, $2^{nd}$ edition (1997).

In the examples, spectrophotometric measurements were made using an Optronik Multiflash M45 spectrophotometer and a commercial color evaluation software package. CIE illuminant $D_{65}$ was used. The color strength was read from a card wrap sample at measurement angles of 20, 25, 35, 45, 55, 65, 75 and 115 degrees. Color Strength values are the average of all 8 viewing angles. Color strength measured as percent for the examples of the invention are measured by comparison to the same blend with no sulfonated polyester (SPBT) or to an as spun (undrawn) SPBT containing fiber with the same colorants.

Colorants are shown in Tables 1–4. PY150=pigment yellow 150, PV29=pigment violet 29, PB15:1= pigment blue 15:1, PBk7=pigment black 7, PBk6=pigment black 6, PW6 pigment white 6, PR101=pigment red 101, PR179= pigment red 179, PG7=pigment green 7, PBr24=pigment brown 24, ZnO=zinc oxide (pigment white 4). Cu Hal= copper halide. Colorants were compounded as concentrates in polyamide6 or PET.

SPBT (sulfonated polybutylene terephthalate) was made by polymerization of dimethyl terephthalate, butane diol and dimethyl sodium sulfo isophthalate. The copolymer contains 13 wt. % sodium sulfo isophthalate. It has an intrinsic viscosity in 60/40 phenol tetrachloroethane of 0.45 dl/g. The same SPBT was used in all examples.

Polyamide Viscosity: The relative solution viscosity (RV) of the polyamides used in the examples was determined by first preparing a 0.55% wt. solution of the dried polyamide in 96% sulfuric acid. Solution flow times were determined in a Cannon-Ubbelohde size 2 viscometer suspended in a temperature controlled water bath set at a temperature of 25° C. 0.02° C. The flow times of the sulfuric acid were also measured. The RV was then calculated by dividing the flow time of the polyamide solution by the flow time of the sulfuric acid. Polyamide 6,6 of the examples has a RV of 3.1, and the polyamide 6 has a RV=2.7.

All yarn denier values have the units g/9000 m.

Examples 1–4 Table 1

Polyamide 6,6 pellets were melt blended with 16 wt. % of a SPBT copolymer along with polyamide 6 color concentrates as shown in Table 1, on a single screw extruder at 285° C. All resins had been dried to below 1000 ppm moisture prior to extrusion. The resultant extrudate was chopped into pellets, dried and extruded into fibers on a slow speed spinning line. The fibers were 1850 denier with a trilobal (Y) cross section. Take up speed was 470 m/min. The different colored yarns had 30 filaments per bundle and are referred to as the 1850/30Y samples. The yarn was then heated to 170° C. and single stage drawn at a draw ratio of 3.6 to produce the drawn (1850/30Y DWN) samples. The drawn yarn was then precision wound onto an aluminium card on which spectrophotometric measurements were made.

Control samples where the 16 wt. % SPBT was replaced with polyamide 6,6 were prepared using the same pigments and the same process.

The yarn samples of the invention were compared to the controls of the same color and the color strength compared. In Table 1 it can be seen that the K/S color strength of the drawn SPBT containing samples is 104 to 135.8% more intense than the control colors with no SPBT. The improved color strength is greatest in examples 2 and 4, the ochre and olive colors, but still significant in the red and teakwood colors (examples 1 and 3).

TABLE 1

| Examples | 1 | 2 | 3 | 4 |
|---|---|---|---|---|
| Color | Teakwood 1850/30Y DWN | Ochre 1850/30Y DWN | Red 1850/30Y DWN | Olive 1850/30Y DWN |
| Polyamide 6, 6 3.1 RV/wt. % | 78.966 | 79.0005 | 79.5447 | 79.0329 |
| Polyamide 6 | 4.8 | 4.6 | 3.7 | 4.7 |
| SPBT 13 wt. % SIP | 16.0 | 16.0 | 16.0 | 16.0 |
| Colorants/wt. % | PBr24 = 0.0534 | PY150 = 0.1873 | PY150 = 0.0054 | PY150 = 0.10 |
| | PR101 = 0.0094 | PR101 = 0.0758 | PR179 = 0.6063 | PG7 = 0.0093 |
| | PBk = 0.0054 | PBk6 = 0.0240 | PBk6 = 0.0136 | PBk7 = 0.0277 |
| | PW6 = 0.0858 | PW6 = 0.0324 | PW = 0.050 | PW6 = 0.0501 |
| | ZnO = 0.050 | ZnO = 0.050 | ZnO = 0.050 | ZnO = 0.050 |
| Stabilizer/wt. % | Cu Hal = 0.03 | Cu Hal = 0.03 | Cu Hal = 0.03 | Cu Hal = 0.03 |
| Draw ratio | 3.6 | 3.6 | 3.6 | 3.6 |
| Color Strength K/S | 104 | 112.7 | 102.1 | 135.8 |

SPBT = 13 wt. % Na sulfoisophthalate PBT copolymer Color Strength with SPBT vs. control with no SPBT and same pigments Examples 5–7 Controls A–C Table 2

The formulated pigmented fibers of these examples were produced in a manner similar to those described above. All polyamide 6,6 was replaced with polyamide 6 of a RV=2.7. SPBT was used at 20 wt. % of the formulation (Table 2). Extrusion was run at 250° C. The blends were spun into fibers with a round cross section on a high speed spinning line to produce fibers of a 250 denier, 25 filaments per bundle (250/25R). The take up speed was 3700 m/min., with a drawdown ration of 470:1. These samples were then heated at 120° C. and drawn at a draw ratio of 1.25 to produce the drawn (250/25R DWN) samples. Cardwraps of both yarns were prepared for color strength measurements as described above.

Both the as spun and the drawn samples were compared to control samples that were made by replacing all 20 wt. % SPBT with polyamide 6. The as spun SPBT samples (250/25R) and the SPBT drawn samples (250/25R DWN) were compared to the controls having no SPBT. As can be seen in Table 2 the DWN samples (examples 5,6 and 7) have greater color strength (106.8, 104, 105.4) than the drawn controls with no SPBT. On the other hand the as spun fibers with SPBT (controls A and B) show inferior color strength to the as spun controls with no SPBT, (98.3 and 97.6%).

The red color shows somewhat different behaviour. The as spun SPBT sample (Control C) shows higher color strength than the as spun control with no SPBT (102.5%) but the drawn sample with SPBT (example 7) has even better color strength (105.4%).

This set of experiments shows the benefit of drawing the SPBT containing fibers to achieve improved color strength.

TABLE 2

| Examples | 5 | Control A | 6 | Control B | 7 | Control C |
|---|---|---|---|---|---|---|
| Color | Blue 250/25R DWN | Blue 250/25R | Ochre 250/25R DWN | Ochre 250/25R | Red 250/25R DWN | Red 250/25R |
| Polyamide 6/wt. % | 79.3824 | 79.3824 | 79.6805 | 79.6805 | 79.3247 | 79.3247 |
| SPBT 13 wt. % SIP | 20.0 | 20.0 | 20.0 | 20.0 | 20.0 | 20.0 |
| Colorants/wt. % | PV29 = 0.0035 | PV29 = 0.0035 | PY150 = 0.1873 | PY150 = 0.1873 | PY150 = 0.0054 | PY150 = 0.0054 |
| | PB15:1 = 0.6055 | PB15:1 = 0.6055 | PR101 = 0.0758 | PR101 = 0.0758 | PR179 = 0.6063 | PR179 = 0.6063 |
| | PBk7 – 0.0021 | PBk7 – 0.0021 | PBk6 = 0.0240 | PBk6 = 0.0240 | PBk6 = 0.0136 | PBk6 = 0.0136 |
| | PW6 = 0.0065 | PW6 = 0.0065 | PW6 = 0.0324 | PW6 = 0.0324 | PW = 0.050 | PW = 0.050 |
| | ZnO = 0.050 | ZnO = 0.050 | ZnO = 0.050 | ZnO = 0.050 | ZnO = 0.050 | ZnO = 0.050 |
| Stabilizer/wt. % | Cu Hal = 0.03 | Cu Hal = 0.03 | Cu Hal = 0.03 | Cu Hal = 0.03 | Cu Hal = 0.03 | Cu Hal = 0.03 |
| Draw ratio | 1.25 | as spun | 1.25 | as spun | 1.25 | as spun |
| Color Strength K/S | 106.8 | 98.3 | 104 | 97.6 | 105.4 | 102.5 |

SPBT = 13 wt. % Na sulfoisophthalate PBT copolymer

Color Strength with SPBT vs. control with no SPBT and same pigments

Examples 8–10 Control D Table 3

Polyamide 6,6 pellets were extruded with 15 wt. % SPBT and 4 wt. % of a 25:75 Pigment Yellow 150 (PY150) :polyamide 6 color concentrate (batch 1) by weight at 285° C. All materials had been dried to less than 1000 ppm moisture before extrusion. The chopped extrudate was melt spun into fibers on a slow speed spinning line to produce an undrawn yarn of 2100 denier at a take up speed of 470 m/min. The fibers had a trilobal (Y) cross section and 34 filaments per bundle. The yarn was then drawn at 170° C. at a draw ratio of 3.6 to produce the 2100/34Y DWN samples shown in Table 3.

A control sample with added polyamide 6,6 replacing the 15 wt. % SPBT was prepared with the same color concentrate in the same manner. The drawn SPBT yarn was compared to the drawn control with no SPBT. Example 8 shows a color strength improved to 129% in the SPBT containing yarn.

The experiment was then repeated with a different 25:75 PY150/polyamide 6 color concentrate (batch 2). It is know that different batches of color concentrates often give different color strengths even when used in the same formulation processed under similar conditions. Example 9 shows the color strength of a drawn yarn using PY150 batch 2 compared to a control using no SPBT made with PY150 batch 2. The color strength is improved to 115.6%.

In order to further examine the color differences between the two PY150 color concentrate batches two experiments were performed. The drawn 2100/34Y fiber made with no SPBT using PY150 batch 1 was compared to the same composition using PY150 batch 2 (example D). A color strength value of only 89.1% indicates a large difference in color intensity between the two samples. These two samples would be expected to give similar color strengths. In practice in order to use batch 2 to make fibers of the same yellow color it would be necessary to adjust the amount of color concentrate. This adjustment would result in more difficulty in making fibers of matching colors. Batch to batch variation of fiber colors would be very detrimental to the manufacture of uniform woven, knitted or pile textiles, carpets or floor-coverings.

When the same two batches of PY150 polyamide 6 concentrate were used to color a polyamide 6,6 2100/34Y DWN drawn fiber sample with 15 wt. % SPBT there is much less variation in the color strength. Example 10 compares the color strength of a drawn fiber made with 15 wt. % SPBT and PY150 batch 2 concentrate to the same type of drawn fiber made with the batch 1 concentrate. The color strength of the batch 2 sample compared to the batch 1 sample is 98.5% indicating that the two samples are closely color matched.

TABLE 3

| Examples | 8 | 9 | Control D | 10 |
|---|---|---|---|---|
| Colo | PY150 2100/34Y DWN | PY150 2100/34Y DWN | P150 2100/34Y DWN | PY150 2100/34Y DWN |
| Polyamide 6, 6 3.1RV/wt. % | 81.0 | 81.0 | 96.0 | 81.0 |
| Polyamide 6/ wt. % | 3.0 | 3.0 | 3.0 | 3.0 |
| SPBT 13 wt. % SIP | 15.0 | 15.0 | 0 | 15.0 |
| PY150 Batch 1/ wt. % | 1.0 | 0 | 1.0 | 0 |
| PY150 Batch 2/ wt. % | 0 | 1.0 | 0 | 1.0 |

TABLE 3-continued

| Examples | 8 | 9 | Control D | 10 |
|---|---|---|---|---|
| Draw ratio | 3.6 | 3.6 | 3.6 | 3.6 |
| Color Strength K/S | 129.4 | 115.6* | 89.1** | 98.5*** |

SPBT = 13 wt. % Na sulfoisophthalate PBT copolymer
Color Strength with SPBT vs. control with no SPBT and same pigments
*= Color Strength PY150 batch 2 with SPBT vs. PY150 Batch 1 no SPBT
**= Color Strength PY150 batch 1 no SPBT vs. PY150 Batch 2 no SPB
***= Color Strength PY150 batch 2 with SPBT vs. PY150 Batch 1 with SPBT Examples 11–12 Controls E–F Table 4

These examples extend the invention to PET fibers. In this case PET pellets (IV=0.67 dl/g) were combined with 15 wt. % SPBT and the indicated single pigment concentrates. PET was used as the carrier resin for the concentrates. This mixture of pellets was ground to a fine powder and dried to less than 50 ppm moisture and extruded into filaments at 285° C. at a take up speed of 3250 m/min. As indicated in Table 4 two colors were made. The fibers were 255 and 170 denier with a round cross section with 34 filaments per bundle. A similar set of fibers was prepared using the same pigments but replacing the SPBT with PET.

Example 11 compares a drawn navy color SPBT blend with a drawn control having no SPBT. Color Strength is improved to 111.2%. In a yellow color the drawn SPBT blend shows a color strength of 106.0% compared to a drawn control with no SPBT (example 12).

Control examples E and F show that the as spun fibers with SPBT, with no drawing, do not show the enhanced color strength achieved in the SPBT containing drawn fibers of the invention.

TABLE 4

| Examples | 11 | Control E | 12 | Control F |
|---|---|---|---|---|
| Color | Navy 170/34R DWN | Navy 170/34R | Sunstraw 255/34R DWN | Sunstraw 255/34R |
| PET 0.67 IV/wt. % | 83.179 | 83.179 | 84.0109 | 84.0109 |
| SPBT 13 wt. % SIP | 15.0 | 15.0 | 15.0 | 15.0 |
| Colorants/ wt. % | PB15:1 = 0.9218 PR149 = 0.6008 PBk7 = 0.2256 PW6 = 0.0728 | PB15:1 = 0.9218 PR149 = 0.6008 PBk7 = 0.2256 PW6 = 0.0728 | PY150 = 0.2758 PR101 = 0.4412 PBk6 = 0.0465 PW6 = 0.2256 | PY150 = 0.2758 PR101 = 0.4412 PBk6 = 0.0465 PW6 = 0.2256 |
| Draw ratio | 1.25 | as spun | 1.25 | as spun |
| Color Strength K/S | 111.2 | 98.8 | 106 | 99.4 |

SPBT = 13 wt. % Na sulfoisophthalate PBT copolymer

Color Strength with SPBT vs. control with no SPBT and same pigments

What is claimed is:

1. A process to prepare a colored synthetic polyamide or polyester fiber with improved color strength that comprises melt blending a polyamide or polyester resin, a colorant, 0.5–30% of an alkylene aryl polyester sulfonate salt copolymer having metal sulfonate units represented by the formula:

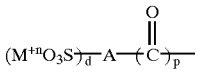

or the formula:

$$(M^{+n}O_3S)_d\text{-}A\text{-}(OR''OH)_p$$

where p=1–3, d=1–3, p+d=2–6, n=1–5, and A is an aryl group containing one or more aromatic rings where the sulfonate substituent is directly attached to an aryl ring, R" is a divalent alkyl group and the metal sulfonate group is bound to the polyester through ester linkages, forming said melt blend into filaments and drawing said filaments into fibers, and wherein the metal sulfonate salt copolymer is insoluble in water.

2. A process of claim 1 where the metal sulfonate polyester copolymer (a) has the following formula:

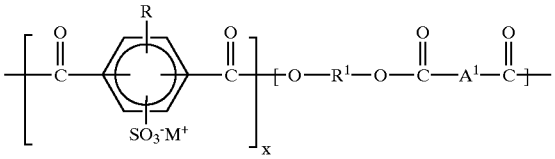

where the ionomer units, x, are from 0.1–50 mole %, R is halogen, alkyl, aryl, alkylaryl or hydrogen, $R^1$ is derived from a diol reactant comprising straight chain, branched, or cycloaliphatic alkane diols and containing from 2 to 12 carbon atoms, $A^1$ is a divalent aryl radical.

3. A process of claim 2 wherein R is hydrogen, x=0.5–15 mole percent, $R^1$ is $C_2$–$C_8$ alkyl, and $A^1$ is derived from iso- or terephthalic acid or a mixture of the two.

4. A process according to claim 1 where p=2, d=1, and M is an alkaline or alkaline earth metal, zinc or tin.

5. A process of claim 2 wherein the metal sulfonate polyester is a alkylene polyester wherein $A^1$ is the residue from a diacid component of iso or tere phthalic acid and derivatives thereof and $R^1$ is the residue from a diol component selected from the group consisting essentially of ethylene glycol, propanediol, butanediol, or cyclohexanedimethanol, and derivatives thereof.

6. A process of claim 1 where the metal sulfonate salt unit is a sulfo iso- or tere-phthalate.

7. A process of claim 1 where the polyamide is selected from the group consisting of: polyamide 6, polyamide 6,6, polyamide 6,12, polyamide 11, polyamide 12, and mixtures thereof.

8. A process of claim 1 where the polyester is selected from the group consisting of polyethylene terephthalate, polypropylene terephthalate, polybutylene terephthalate, polyethylene naphthanoate, polypropylene naphthanoate, polybutylene naphthanoate, polycyclohexanedimethanol terephthalate and mixtures thereof.

9. A process of claim 1 wherein the colorant is selected from the group consisting of metal oxides, mixed metal oxides, metal sulfides, zinc ferrites, sodium alumino sulfosilicate pigments, carbon blacks, phthalocyanines, quinacridones, nickel azo compounds, mono azo colorants, anthraquinones and perylenes.

10. A process of claim 9 wherein the colorant is selected from the group consisting of: Carbon Black, Titanium Dioxide, Zinc Sulfide, Zinc Oxide, Ultramarine Blue, Cobalt Aluminate, Iron Oxides, Pigment Blue 15, Pigment Blue 60, Pigment Brown 24, Pigment Red 122, Pigment Red 147, Pigment Red 149, Pigment Red 177, Pigment Red 178, Pigment Red 179, Pigment Red 202, Pigment Red 272, Pigment Violet 19, Pigment Violet 29, Pigment Green 7, Pigment Yellow 119, Pigment Yellow 147 and Pigment Yellow 150.

11. A process of claim 1 where the colorant is present from 0.1–8.0% by weight of the total composition.

12. A process of claim 1 where the colorant is first combined with a polyamide, polyester, sulfonated polyester or a mixture thereof to form a color concentrate which is subsequently used in the fiber forming process.

13. A process of claim 1, additionally containing an adjuvant.

14. A process of claim 13, wherein said adjuvant is an antioxidant, stabilizer, processing aid, antimicrobial, flame retardant, antiozonants, soilproofing agent, stainproofing agent, antistatic additive, lubricants, melt viscosity enhancer, or mixtures thereof.

15. A process of claim 1 where the draw ratio is from 1.05 to 7.00.

16. A process of claim 1 where the draw ratio is from 1.10 to 6.00.

17. A process to prepare a colored synthetic polyester fiber with improved color strength that comprises melt blending a polyester resin, a colorant, 0.5–30% of an alkylene aryl polyester sulfonate salt copolymer having metal sulfonate units represented by the formula:

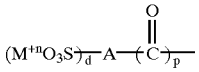

or the formula:

$$(M^{+n}O_3S)_d\text{-}A\text{-}(OR''OH)_p$$

where p=1–3, d=1–3, p+d=2–6, n=1–5, and A is an aryl group containing one or more aromatic-rings where the sulfonate substituent is directly attached to an aryl ring, R" is a divalent alkyl group and the metal sulfonate group is bound to the polyester through ester linkages, forming said melt blend into filaments and drawing said filaments into fibers.

18. A process of claim 17 where the polyester is selected from the group consisting of polyethylene terephthalate, polypropylene terephthalate, polybutylene terephthalate, polyethylene naphthanoate, polypropylene naphthanoate, polybutylene naphthanoate, polycyclohexanedimethanol terephthalate and mixtures thereof.

* * * * *